US006194663B1

(12) United States Patent
Friesen et al.

(10) Patent No.: US 6,194,663 B1
(45) **Date of Patent: *Feb. 27, 2001**

(54) LOCAL AREA NETWORK CABLING ARRANGEMENT

(75) Inventors: Harold Wayne Friesen, Dunwoody; David R. Hawkins, Sugar Hill, both of GA (US); Stephen Taylor Zerbs, Gretna, NE (US)

(73) Assignee: Lucent Technologies Inc., Murray Hill, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/808,901

(22) Filed: Feb. 28, 1997

(51) Int. Cl.[7] ..... H01B 11/02
(52) U.S. Cl. ..... 174/110 R; 174/113 R
(58) Field of Search ..... 174/27, 34, 36, 174/113 R, 115, 110 R

(56) References Cited

U.S. PATENT DOCUMENTS

| | | | | |
|---|---|---|---|---|
| 4,873,393 | | 10/1989 | Friesen et al. | 174/34 |
| 5,424,491 | * | 6/1995 | Walling et al. | 174/113 R |
| 5,493,071 | * | 2/1996 | Newmoyer | 174/113 R |
| 5,527,996 | * | 6/1996 | Ham | 174/113 R |

OTHER PUBLICATIONS

U.S. application No. 08/792,609 filed Jan. 1997 by Friesen et al.*

PCT Application No. PCT/US97/00029, entitled "Paired Electrical Cable Having Improved Transmission Properties and Method for Making Same," filed Jan. 3, 1997.

* cited by examiner

*Primary Examiner*—Kristine Kincaid
*Assistant Examiner*—William H Mayo, III

(57) ABSTRACT

A cabling media which is suitable for high performance data transmission includes a plurality of metallic conductors-pairs, each pair including two plastic insulated metallic conductors which are twisted together. The present invention describes how the selection and incorporation of metallic conductors having different diameters within a single communication cable can significantly enhance the operational performance of the cable. More specifically, given a first conductor-pair having a certain conductor diameter and twist length, and at least one other conductor-pair with a different twist length, the present invention purposely selects metallic conductors for this other conductor-pair with a different diameter than that of the first conductor-pair so as to ensure that the insertion loss exhibited by the additional conductor-pair is essentially equal to the insertion loss exhibited by the first conductor-pair. The differing conductor diameters allows compensation for the variance in insertion loss from one conductor-pair to the next due to changes in the twist length employed for the plurality of conductor-pairs. Additionally, it is described herein that the insulation thickness of the conductors may be altered from conductor-pair to conductor-pair to ensure that the characteristic impedance measured for the additional conductor-pair is essentially equal to the characteristic impedance measured for the first conductor-pair. As a result of the particular selection of conductors with differing diameters and/or insulation thicknesses for at least two of the conductor pairs, the operational performance of the resulting cable is improved.

14 Claims, 3 Drawing Sheets

LOCAL AREA NETWORK CABLING ARRANGEMENT

TECHNICAL FIELD

This invention relates to an improved local area network cabling arrangement. More specifically, it relates to a particular cable design which due to its unique construction, most notably, the inclusion of metallic conductors with differing diameters and insulation thicknesses within a single cable, is capable of establishing that the insertion loss and characteristic impedance value for any one of the individual conductor-pairs closely matches to the insertion loss and characteristic impedance values of the other pairs in the cable.

BACKGROUND OF THE INVENTION

Along with the greatly increased use of computers for offices and for manufacturing facilities, there developed a need for a cable which may be used to connect peripheral equipment to mainframe computers and to connect two or more computers into a common network. Of course, given the ever-increasing demands for data transmission, the sought-after cable desirably should not only provide substantially error-free transmission at relatively high bit rates or frequencies but also satisfy numerous other elevated operational performance criteria. Specifically, the particular cable design of the present invention consistently performs at operational levels which exceed the transmission requirements for cables qualifying as Category 5 cables under TIA/EIA-568A. The particular operational performance aspects that the cable design of this invention can reliably and consistently enhance over existing cables, include the degree to which the insertion loss and characteristic impedance value of one conductor-pair is matched to the insertion loss and characteristic impedance values of the other conductor-pairs within the same cable.

Not surprisingly, of importance to the design of metallic-conductor cables for use in local area networks are the speed and the distances over which data signals must be transmitted. In the past, this need had been one for interconnections operating at data speeds up to 20 kilobits per second and over a distance not exceeding about 150 feet. This need was satisfied with single-jacket cables which may comprise a plurality of insulated conductors that were connected directly between a computer, for example, and receiving means such as peripheral equipment. Currently, equipment, generally identified throughout the industry as Category 3 products, is commercially available that can effectively transmit up to 16 MHz data signals and a series of products designated as Category 5 provide the capability of effectively transmitting up to 100 MHz data signals.

The objectives being demanded by cable customers, including local area network (LAN) vendors and distribution system vendors, are becoming increasingly stringent. This is true for both the breadth of the types of features demanded as well as the technical wherewithal necessary to accomplish the new requests from customers. In this regard, further advances in the operational performance of LAN cables are becoming increasingly difficult.

The unshielded twisted pair has long been used for telephone transmission in the balanced (differential) mode. Used in this manner, the unshielded twisted pair has excellent immunity from interference whether from the outside (EMI) or from signals on other pairs (crosstalk). Another point of concern with the use of such cables is that each cable be designed so as not to emit electromagnetic radiation from the cable into the surrounding environment. Over the past several years, in fact, some LAN designers, have come to realize the latent transmission capability of unshielded twisted pair wire. Especially noteworthy is the twisted pair's capability to transmit rugged quantized digital signals as compared to corruptible analog signals.

In an attempt to enhance the operational performance of twisted pair cables, manufacturers have employed a variety of different twist schemes. As used herein, twist scheme is synonymous with what the industry sometimes calls twinning or pairing. In general, twist scheme refers to the exact length and type/lay of twist selected for each conductor pair. More specifically, in one such twist scheme particularly described in commonly-assigned U.S. Pat. No. 4,873,393 issued in the names of Friesen and Nutt and which is hereby expressly incorporated by reference, it is stated that the twist length for each insulated conductor pair should not exceed the product of about forty and the outer diameter of the insulation of one of the conductors of the pair. While this is just one example of an existing approach for defining a twist scheme which results in an enhanced cable design, many others exist.

As a more recent piece of prior art, the reader's attention is drawn to a unique twist scheme set forth in commonly-assigned patent application filed in the names of Friesen, Hawkins and Zerbs on Jan. 31, 1997 and which is expressly incorporated by reference herein. This document describes a particular series of conductor-pair twist lengths that when used together in a single cable provide operational performance values that significantly surpass the requirements of TIA/EIA-568A.

However, in addition to controlled pair twist schemes, another treatment for crosstalk is to add shielding over each twisted pair to confine its electric and magnetic fields. However, as the electric and magnetic fields are confined, resistance, capacitance and inductance all change, each in such a way as to increase transmission loss. For instance, it is not unusual to find designs of shielded pairs whose attenuation is three times that of similar unshielded pairs. Even in light of these positions regarding shielded cables, it should be understood by the reader that a cable can benefit from the teachings of this document whether the sheath system of the cable includes a shielding element of some type or not.

Notwithstanding the aforementioned problems and solutions, there still appears to be a need for a cable that satisfies the criteria discussed above and also addresses the need for communication cables, particularly LAN cables, to provide more consistent insertion loss and characteristic impedance values between the various conductor-pairs within a single cable.

SUMMARY OF THE INVENTION

The foregoing problems have been overcome by a cabling arrangement of this invention which is capable of high rate transmission of data streams at a relatively low level of crosstalk, but also provides significant enhancement in the balance of insertion loss and characteristic impedance from one conductor-pair to other conductor-pairs. In general, the present invention relates to a cabling media which is suitable for high performance data transmission and includes a plurality of metallic conductors-pairs, each pair including two plastic insulated metallic conductors which are twisted together.

Specifically, the present invention describes how the selection and incorporation of metallic conductors having different diameters within a single communication cable can significantly enhance the operational performance of the cable. In particular, given a first conductor-pair having a certain conductor diameter and twist length, and at least one other conductor-pair with a different twist length, the present invention purposely selects metallic conductors for this at least one other conductor-pair with a different diameter than that of the first conductor-pair so as to ensure that the insertion loss exhibited by the additional conductor-pair is essentially equal to the insertion loss exhibited by the first conductor-pair. The differing conductor diameters allows compensation for the variance in insertion loss from one conductor-pair to the next due to changes in the twist length employed for the plurality of conductor-pairs.

In a slightly different embodiment of the present invention, it is described herein that the insulation thickness of the conductors may be altered from conductor-pair to conductor-pair to ensure that the characteristic impedance measured for the additional conductor-pair is essentially equal to the characteristic impedance measured for the first conductor-pair. As a result of the particular selection of conductors with differing metallic diameters and/or insulation thicknesses for at least two of the conductor pairs, the operational performance of the resulting cable is improved.

BRIEF DESCRIPTION OF THE DRAWING

Other features of the present invention will be more readily understood from the following detailed description of specific embodiments thereof when read in conjunction with the accompanying drawings, in which.

DETAILED DESCRIPTION

Figure 1A:
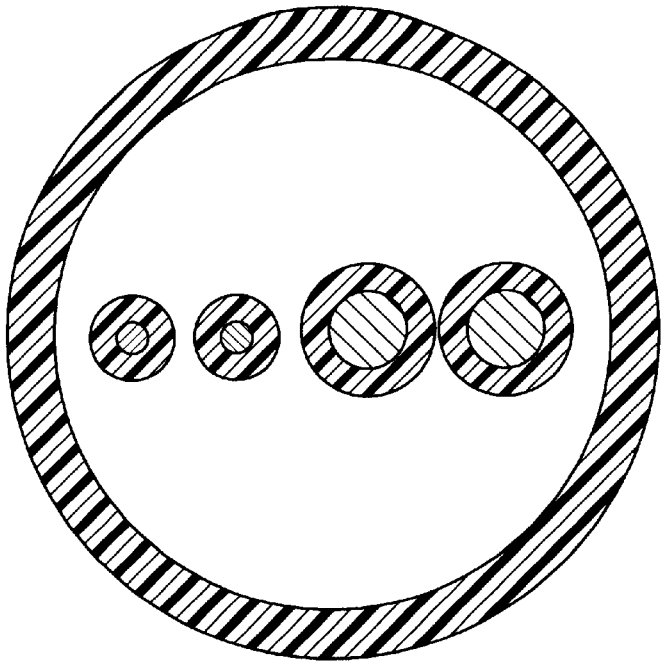
FIGS. 1*a* and 1*b* are perspective views of two embodiments, one shielded and one unshielded, of a cable of this invention for providing substantially error-free data transmission over relatively long distances.
Figure 1B:
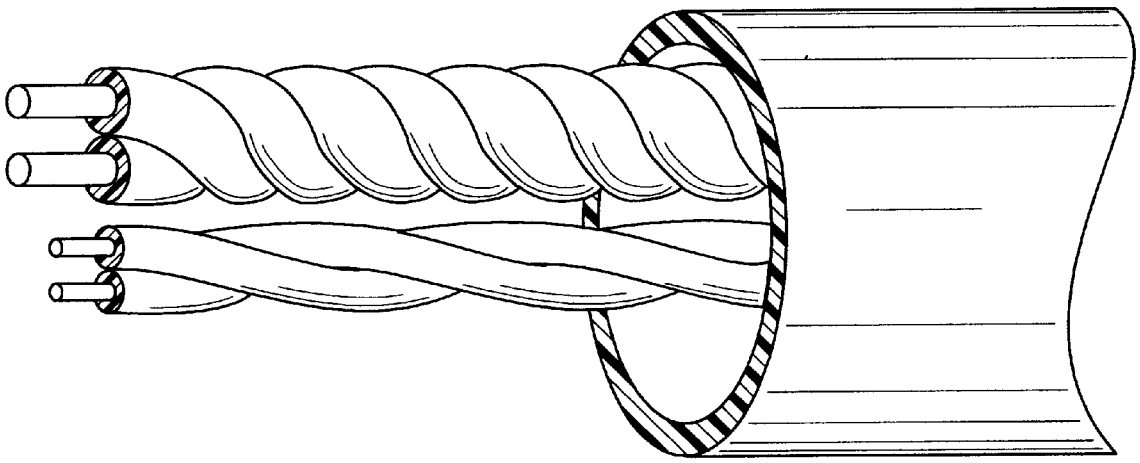

Referring now to FIGS. 1*a* and 1*b*, there are shown two embodiments of a data transmission cable which is designated generally by the numeral 20. Specifically, FIG. 1*a* depicts an unshielded embodiment and FIG. 1*b* depicts a shielded version of the present invention. While the difference between these two embodiments shown resides in the sheath system, it should be understood that the focus of the present invention is the particular selection and arrangement of the transmission media therein, which is equally applicable to both embodiments.

Figure 2:
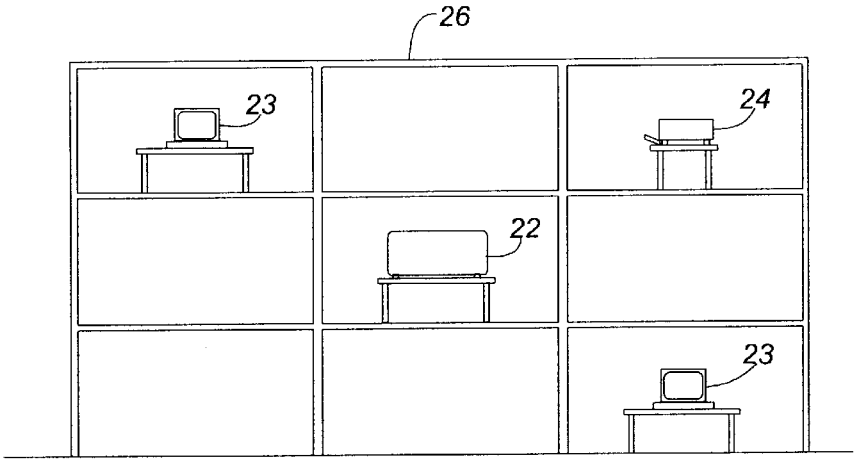
FIG. 2 is an elevational view of a building to show a mainframe computer, personal computers and peripherals linked by the cable of this invention.

Typically, the cable 20 is used to network one or more mainframe computers 22—22, many personal computers 23—23, and/or peripheral equipment 24 on the same or different floors of a building 26 (see FIG. 2). The peripheral equipment 24 may include a high speed printer, for example, in addition to any other known and equally suited devices. Desirably, the interconnection system minimizes interference on the system in order to provide substantially error-free transmission.

Figure 3:
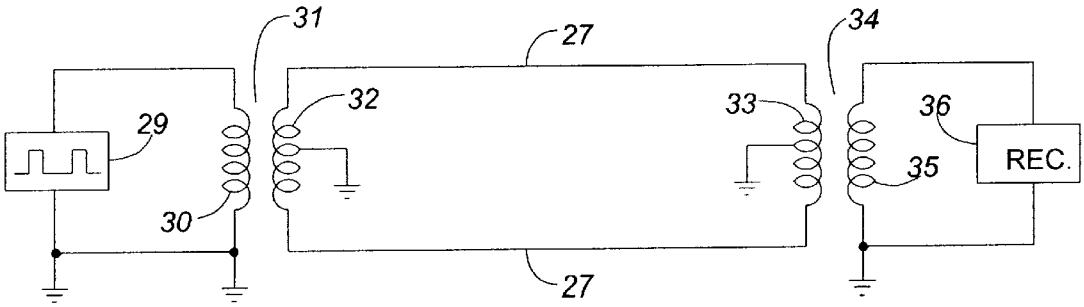
PRIOR ART FIG. 3
FIG. 3 is a schematic view of a pair of insulated conductors in an arrangement for balanced mode transmission.

The cable 20 of this invention is directed to providing substantially error-free data transmission in a balanced mode. More specifically, the particular cable design of the present invention simultaneously elevates a series of operational performance criteria to levels consistently exceeding present industry standards for high-performance metallic-conductor cables. In general, a balanced mode transmission system which includes a plurality of pairs of individually insulated conductors 27—27 is shown in FIG. 3. Each pair of insulated conductors 27—27 is connected from a digital signal source 29 through a primary winding 30 of a transformer 31 to a secondary winding 32 which is center-tap grounded. The conductors are connected to a winding 33 of a transformer 34 at the receiving end which is also center-tap grounded. A winding 35 of the transformer 34 is connected to a receiver 36. With regard to outside interference, whether it be from power induction or other radiated fields, the electric currents cancel out at the output end. If, for example, the system should experience an electromagnetic interference spike, both conductors will be affected equally, resulting in a null, with no change in the received signal.

Further, there is a generally-accepted requirement that the outer diameter of the cable 20 not exceed a predetermined value and that the flexibility of the cable be such that it can be installed easily. The cable 20 has a relatively small outer diameter, i.e. in the range of about 0.1 inch to 0.5 inch, and is both rugged and flexible thereby overcoming the many problems encountered when using a cable with individually shielded pairs. The resulting size of the cable depends on a variety of factors including the number conductor pairs used as well the type of sheath system selected. The particular cable of the preferred embodiment of the present invention recites the inclusion of four conductor-pairs within the cable design. However, while the cable 20 of the present invention may, in fact, include any number of conductors, it is noted that present industry desires appear to call for between two and twenty-five pairs of insulated conductors within a single cable.

While the general cable structure and envisioned application described above may relate to any number of high performance communication cable designs, the particular advantages of the present invention over the prior art is attributable to the novel teaching of the present invention that purposely selecting and incorporating metallic conductors having different diameters into a single communication cable significantly enhances the operational performance of the cable. More specifically, given a first conductor-pair having a certain conductor diameter and twist length, and at least one other conductor-pair with a different twist length, the present invention purposely selects metallic conductors for this at least one other conductor-pair with a different diameter than that of the first conductor-pair. As discussed in greater detail below, such a design ensures that the insertion loss exhibited by the additional conductor-pair is essentially equal to the insertion loss exhibited by the first conductor-pair. In general, the differing conductor diameters allows compensation for the variance in insertion loss from one conductor-pair to the next due to changes in the twist lengths employed for the plurality of conductor-pairs.

Additionally, it is described herein that the insulation thickness of the conductors may be altered from conductor-pair to conductor-pair to ensure that the characteristic impedance measured for the additional conductor-pair is essentially equal to the characteristic impedance measured for the first conductor-pair. As a result of the particular selection of conductors with differing diameters and/or insulation thicknesses for at least two of the conductor pairs, the operational performance of the resulting cable is improved.

In support of the design criteria described immediately above, it should be noted that the characteristic impedance ($Z_o$) of a cable will vary as a result of changes in any or all of the following: copper conductor size, overall wire diameter (i.e. conductor diameter plus insulation thickness), choice of insulation material, or any combination of these three. Furthermore, one should also realize that, while it may not be readily apparent, $Z_o$ also changes with twist length.

In the preferred embodiment of the present invention, both the diameter of the metallic conductor and the insulation thickness of various conductor-pairs are both varied within the design of a single cable. However, while it is optimum to vary both the size of the metallic conductor and the insulation thickness of various conductor-pairs, it should be noted by the reader that benefits may be realized by varying only one of these parameters. In this regard, the scope of the present invention is directed to varying each of these features independently even though the best mode as depicted below illustrates a cooperative varying of both the size of the metallic conductor and the insulation thickness of various conductor-pairs within a single cable.

For the purposes of illustrating at least two preferred embodiments of this invention, the particular material used as the insulation is varied. In particular, examples are set forth herein for both cable designs having a highly flame-retardant material, such as fluorinated ethylene propylene (FEP), as the insulation for plenum cable applications, as well as other less flame retardant materials, such as high-density polyethylene (HDPE), for cable designs for use in non-plenum and/or non-halogen qualifying applications. It is understood that many other known materials classified as fluoropolymers and polyolefins may also be used as appropriate insulation materials in accordance with the present invention. As can be seen from the tables below, the choice of different insulation materials changes the optimum values for insulation thickness for a given metallic conductor size. Therefore, regardless of the type of insulation material selected, implementing the teachings described herein, namely varying the size of the metallic conductor and/or the insulation thickness of various conductor-pairs within a single cable, is deemed to be within the scope of the present invention.

The particular examples of a preferred embodiment set forth below utilize the unique twist scheme set forth in commonly-assigned patent application filed in the names of Friesen, Hawkins and Zerbs on Jan. 31, 1997, mentioned in the Background of the Invention above and expressly incorporated by reference herein. More specifically, the targeted twist lengths for four conductor-pairs are 0.440, 0.410, 0.596, and 0.670 inches when the size of the conductors used are 24 gage. However, neither the particular twist lengths, nor the specific conductor size, selected are the crux of the present invention, but instead are provided as exemplary only. In this regard, using different dimensions for metallic conductor diameters and/or the insulation thicknesses as a result of different twist lengths, regardless of the particular twist scheme employed, is not believed to escape the scope of the present invention. Similarly, to employ the varied conductor size and/or insulation thickness for wire gages other than 24, such as 22, 26, etc., is also believed to remain within the scope of the present invention.

In order to assist in describing the cable arrangement of the preferred embodiment of the present invention, each of the four conductor-pairs is referred to herein as either pair 1, 2, 3, or 4. More specifically, in one arrangement of conductor-pairs which may be used in accordance with a preferred embodiment, the two twisted pairs with the shortest twist lengths, hereinafter pair number 1 and 2, are positioned diagonal relative to each other, while the two twisted pairs with the longest twist lengths, hereinafter pair number 3 and 4, are likewise positioned diagonal relative to each other.

In such a diagonal arrangement of conductor-pairs, the two conductor-pairs establishing one diagonal combination may have twist lengths somewhat similar to each other, as might the other two conductor-pairs establishing the other diagonal arrangement. The relatively close twist lengths configuration of the two sets of diagonally positioned pairs may allow a manufacture to limit the number of different conductors that must be used in order to reap the benefits of the present invention without going to the trouble of using a different size metallic conductor for each of the conductor-pairs within a given cable. To complete this example, a manufacture may use one size of conductors for the pairs creating one diagonal and another size of conductors for the pairs establishing the other diagonal. In other words, the dimensions of the tip and ring conductors in pair 1 are essentially identical in size to those in pair 2, and the dimensions of the tip and ring conductors of pair 3 essentially match those of pair 4.

In fact, the particular twist lengths selected for the preferred embodiment of this invention happen to be such that the use of only two different conductor sizes and insulation thicknesses is needed to reap most of the benefits of this invention. More specifically, since the twist lengths of conductor-pairs 1 and 2 are relatively close to each other and the twist lengths of conductor-pairs 3 and 4 are relatively close to each other, these two sets of conductor-pairs may be treated as only two units for the purposes of implementing this invention as opposed to four separate units. Notwithstanding the above, to vary the conductor size and/or insulation thickness for more than two of the conductor-pairs within a single cable, is the intended scope of the present invention. In other words, the present invention teaches varying the conductor diameter and/or insulation thickness for any number of conductor-pairs within a single cable, including all if such is desired.

EXAMPLE ONE

For a cable design using the twist scheme described immediately above and a high-density polyethylene as the material used to insulate the metallic conductors, conductor-pairs 1 and 2 have a diameter of about 21.5 mils while conductor-pairs 3 and 4 have a diameter of about 20.9 mils. Furthermore, the insulation thickness for conductor-pairs 1 and 2 is about 8.45 mils resulting in an overall insulated conductor diameter of about 38.4 mils, while the insulation thickness for conductor-pairs 3 and 4 is about 7.9 mils resulting in an overall insulated conductor diameter of about 36.7 mils. The manufacturing tolerances for the thickness of HDPE insulation is presently about 0.30 mils.

The tables below illustrate some of the design criteria, namely the twist lengths for each conductor-pair, the diameter of the metallic conductor used in each pair, and the diameter of the conductor after insulation material is applied, in combination with the certain resulting operational values, namely characteristic impedance and insertion loss, measured for each conductor-pair. The first table immediately below sets forth values for a cable using a high-density polyethylene as the selected insulation material.

| Pair number | 1 | 2 | 3 | 4 |
|---|---|---|---|---|
| Twist Length Specification (inches) | 0.440 | 0.410 | 0.596 | 0.670 |
| Metallic Conductor Diameter (mils) | 21.5 | 21.5 | 20.9 | 20.9 |
| Insulation Thickness (mils) | 8.45 | 8.45 | 7.9 | 7.9 |
| Insulated Conductor Diameter (mils) | 38.4 | 38.4 | 36.7 | 36.7 |
| Characteristic Impedance ($Z_o$) (Ohms) | 100.22 | 99.40 | 100.02 | 100.93 |
| Insertion Loss (% re Cat-5) | 12.96 | 11.63 | 12.42 | 13.99 |

EXAMPLE TWO

For a cable design using the same set of twist lengths described immediately above but with a fluorinated ethylene propylene (FEP) as the material used to insulate the metallic conductors, conductor-pairs 1 and 2 again have a diameter of about 21.5 mils while conductor-pairs 3 and 4 again have a diameter of about 20.9 mils. However, the insulation thickness for conductor-pairs 1 and 2 is about 7.9 mils resulting in an overall insulated conductor diameter of about 37.3 mils while the insulation thickness for conductor-pairs 3 and 4 is about 7.2 mils resulting in an overall insulated conductor diameter of about 35.3 mils. The manufacturing tolerances for the thickness of the FEP insulation is presently about 0.33 mils.

| Pair number | 1 | 2 | 3 | 4 |
|---|---|---|---|---|
| Twist Length Specification (inches) | 0.440 | 0.410 | 0.596 | 0.670 |
| Metallic Conductor Diameter (mils) | 21.5 | 21.5 | 20.9 | 20.9 |
| Insulation Thickness (mils) | 7.9 | 7.9 | 7.2 | 7.2 |
| Insulated Conductor Diameter (mils) | 37.3 | 37.3 | 35.3 | 35.3 |
| Characteristic Impedance ($Z_o$) (Ohms) | 100.98 | 99.90 | 100.18 | 100.26 |
| Insertion Loss (% re Cat-5) | 12.90 | 11.21 | 9.86 | 11.49 |

The insertion loss and characteristic impedance data provided for both Example One and Example Two above represents the average values measured from three cable samples made in accordance with each of the embodiments of the present invention described above. Additionally, for completeness it is noted that the characteristic impedance values given above were taken at a frequency of 100 MHz. One of the points that is important to note from each of the tables above, is that the impedance values as well as the insertion loss values are very well matched between the four pairs.

In addition to the specifics of the preferred embodiments of the present invention set forth above, it may be beneficial to generally address some of the technical aspects relating to this invention. As the industry continues to migrate to conductor-pairs having ever tighter twists, i.e., the twist lengths exhibiting a shorter measurement, the resistance in the conductors for a given cable length increases due to the longer electrical path length relative to the overall length of cable. Unfortunately, but not surprisingly, this causes the insertion loss of those pairs with the shorter twists to be higher than the associated conductor-pairs with somewhat longer twist lengths.

More importantly however, is the effect of pair geometry on the mutual capacitance and characteristic impedance of each of the conductor-pairs. As the twists of the pairs get progressively tighter, the mutual capacitance in that pair increases significantly due to the tighter helical geometry employed, while the characteristic impedance decreases albeit at a lessor rate. In other words, at the relatively high frequencies used today, generally speaking, the net effect of a growing mutual capacitance is a decreasing characteristic impedance ($Z_o$). This position is based on the industry-accepted approximation for $Z_o$ at high frequencies stating that $Z_o$ is proportional to the square root of mutual inductance divided by mutual capacitance.

To further identify the advantages gained from a cable designed in accordance with the present invention, and to highlight the reason the essentially uniform characteristic impedances and insertion losses across all four conductor-pairs are achieved, the following mathematical support is provided.

In general, the return loss (RL), as measured in decibels (dB), for a given conductor-pair is given by the following equation:

$$RL = 20\,\mathrm{Log}\left(\frac{1}{|\rho|}\right),$$

where ρ (rho) is given by the following:

$$\rho = \frac{Z_t - Z_o}{Z_t + Z_o}$$

The term rho refers to the reflection coefficient, whose magnitude is a measure of the fractional voltage reflection at an impedance mismatch. The term $Z_o$ is the characteristic impedance of the transmission line, and $Z_t$ is the impedance of the termination. When the two terms differ from one another, as a result of mismatched terminations, the insertion loss is higher in the through-path as a result of some of the signal energy reflecting back through the path. In typical LAN set-ups presently used in the industry, the target for $Z_o$ is 100 Ohms, since the end-device with a balun will have an impedance of nearly exactly 100 Ohms.

With this in mind, there are several places in the channel, between the server and the terminal, where one can find impedance mismatches. The first occurs between the baluns with an associated device and the cable pairs. Another potential point of impedance mismatch occurs between pairs at various cross-connects and/or outlets/plugs. Lastly, the different impedances between pairs in different cables also may result in some impedance mismatch.

Return loss measurements in the laboratory or in the field use 100 Ohms as the reference impedance for any measure of return loss. In order to minimize the amount of loss measured in a channel, the pairs between cables brought together by various connectors should have the same characteristic impedance, and that impedance should be 100 Ohms.

However, it should be understood by the reader that the characteristic impedance derived for a pair should not be confused with the input impedance of that pair. Typically, the pair input impedance is derived from the reflection measurement data, for example by using the open and short circuit method. The input impedance curve with frequency that results is usually consistent or smooth at low frequencies but can have substantial structure, or variations, at high frequencies. In order to properly assess the characteristic impedance of the pair, it is beneficial to function fit through the input impedance data with frequency. The resulting function fit is the characteristic impedance curve.

While the aforementioned method is commonly accepted in the U.S. and Canada, it has yet to find universal acceptance abroad, especially in Europe. In Europe, the characteristic impedance is generally taken as the input impedance. For this reason, a pair, measured in accordance with the method described above (ASTM D-4566) and meeting the characteristic impedance requirement in certain U.S. standards, such as TIA-568A and ICEA S-80-576, may not meet some overseas requirements like ISO/IEC 11801 and En 50173 when measured in accordance with existing European methods as set forth in IEC 1156.

The requirements are the same between the different standards referenced above, specifically 100+/−15 Ohms; however, the interpretations as allowed by the two different test methods bring about dramatically different results. For this reason, all four pairs in a cable should be centered about 100 Ohms as much as possible, so that the input impedance of each pair doesn't drop below 85 Ohms or exceed 115 Ohms due to the structural roughness or variations in the impedance measured for each pair. With this in mind, it should be noted from the tables above that the present invention allows the tolerance for the average characteristic impedance to be essentially lowered from +/−15 ohms to +/−1 ohm.

In addition to the technical discussion provided above, there are significant other reasons that varying the conductor size of one conductor-pair relative to that of other conductor-pairs within a single cable is a significant departure from existing local area network (LAN) cable designs. Typically, LAN cable manufacturers take specific actions to ensure that they use uniform conductors in their cable constructions. The reason for this is that since most cable manufacturers do not, for a variety of reasons, draw and anneal the conductors they use themselves, they must go to an outside source and order the conductors. Most copper wire manufactures will provide reels of metal wire defined by and classified as a given gauge based on the diameter of the metal. Under the industry accepted designation of American Wire Gauge (AWG), the diameters of a particular gauge must fall within prescribed nominal specifications for the applicable gauge. At present, existing standards for most LAN arrangements allow 24, 23 and 22 AWG in a LAN communication system. To be more precise, the nominal diameters of these metallic conductor elements currently are about 20.1, 22.6 and 25.3 mils, respectively. In light of the above-stated industry norm, the ultimate LAN cable users have come to expect to see these dimensions for the conductors in the cables used in their LAN arrangements.

Notwithstanding the above, let's now assume that a cable manufacture has special ordered atypical or nonstandard 24 AWG, 23 AWG or 22 AWG copper conductor within the allowable limits of each gauge, or has the facilities to draw its' own wire to any size within the same constraints. This manufacture will most likely use a matching set of eight conductors in all four pairs of the cable, since to do otherwise would add to the manufacture's inventory. For example, four conductors with insulation colors of blue, orange, green, and brown are each mated with a solid white conductor to establish four different and distinguishable conductor-pairs for use in a cable. As commonly-accepted throughout the industry, this conductor with white insulation is referred to as the ring conductor of each pair while the conductor having a colored insulation is identified as the tip conductor of each pair.

However, if the manufacture decides to use a different size copper element and/or insulation for one or more pairs in accordance with the present invention, then it immediately creates a new inventory listing for the wire with the atypical or nonstandard diameter. In this regard, not only must the tip conductor of the conductor-pair to be varied take on the new dimensions, but the ring or white conductor associated with that tip conductor to complete a given pair must do so as well, otherwise, the pair is significantly unbalanced with regard to its electrical transmission properties. Other cable manufactures keep the conductors uniform to make inventory tracking easier and to avoid inadvertent mishaps involving pair arrangement from occurring during cable construction, i.e., where a conductor-pair is created wherein the size or diameter of the tip conductor is different from the size or diameter of the ring conductor. At the risk of stating the obvious, such pair-arrangement mishaps clearly become more difficult to avoid as the number of component part options, such as conductor size, increase.

Yet another important but non-technical reason implementation of the present invention is desired relates to costs. More specifically, the design of this invention provides significant savings in the cost of both the metallic conductor material, such as copper, as well as materials used as the insulation materials around each of the metallic conductors.

Figure 4:
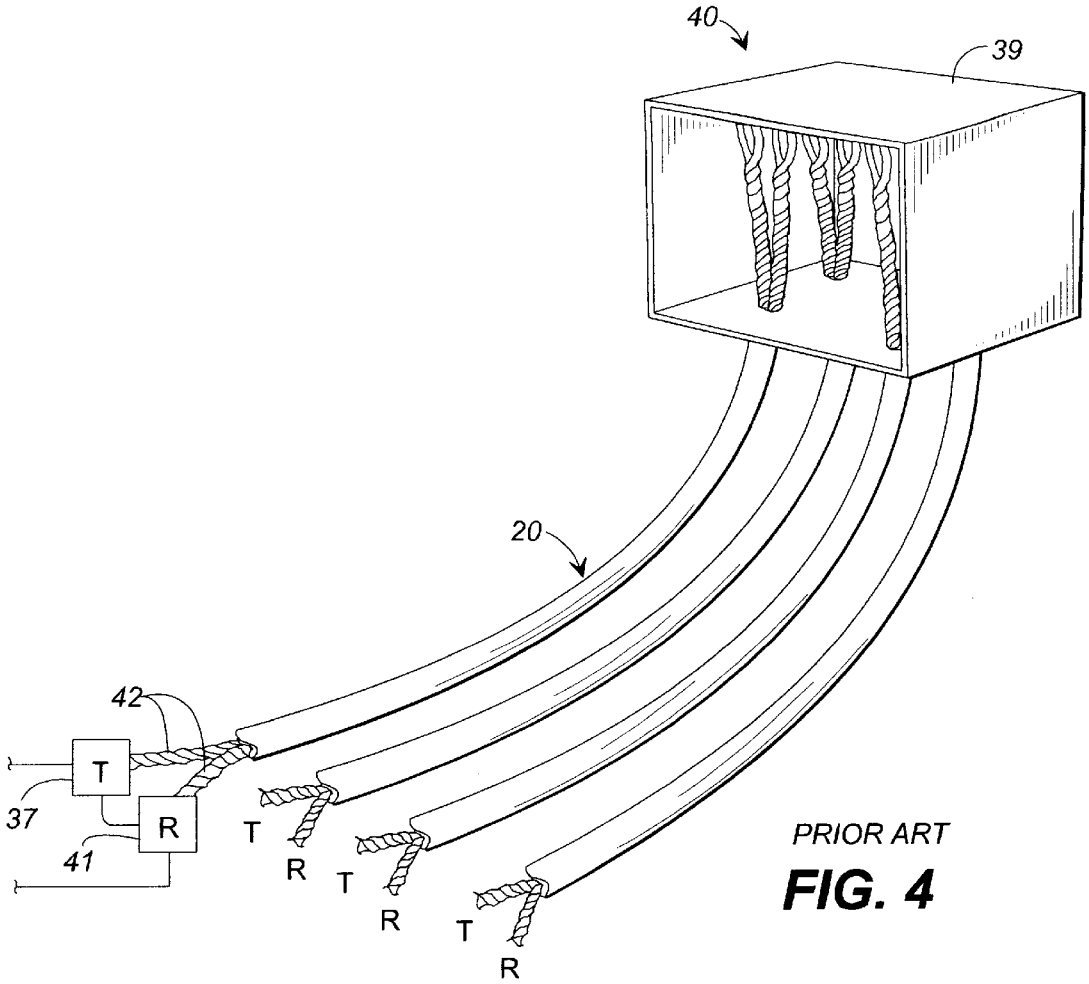
PRIOR ART FIG. 4
FIG. 4 is a view of a data transmission system which includes the cable of this invention.

Referring now to FIG. 4, there is shown an example system 40 in which the cable 20 of this invention is useful. In FIG. 4, a transmitting device 37 at one station is connected along a pair of conductors 42—42 of one cable to an interconnect hub 39 and then back out along another cable to a receiving device 41 at another station. A plurality of the stations comprising transmitting devices 37—37 and receiving devices 41—41 are connected to the interconnect hub 39 and then back out along another cable to a receiving device 41 at another station. A plurality of the stations comprising transmitting devices 37—37 and receiving devices 41—41 may be connected to the interconnect hub in what is referred to as a ring network. As can be seen in this example, the conductors are routed from the transmitting device at one terminal to the hub 39 and out to the receiving device at another terminal, thereby doubling the transmission distance.

Figure 5:
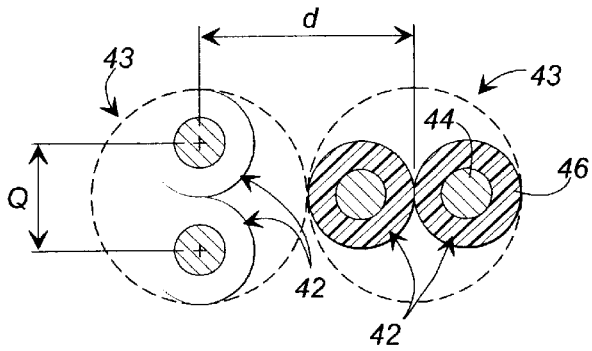
FIG. 5 is a cross-sectional view of two pairs of insulated conductors as they appear in a cable of this invention.

More particularly, the cable 20 of this invention includes a core 45 comprising a plurality of twisted pairs 43—43 of the individually insulated conductors 42—42 (see FIGS. 1*a*, 1*b* and 5) which are used for data transmission. Each of the insulated conductors 42—42 includes a metallic portion 44 (see FIG. 5) and an insulation cover 46. In a preferred embodiment, the insulation cover 46 may be made of any fluoropolymer material, such as TEFLON, or polyolefin material, such as polyethylene or polypropylene. Furthermore, the outer jacket 58 may be made of a plastic material such as polyvinyl chloride, for example.

It should be noted that the present invention may be used in the design of either a shielded or an unshielded cable. In particular, FIG. 1*a* illustrates an unshielded cable design while FIG. 1*b* depicts a shielded cable design. The difference between the two designs resides only in the sheath system selected for the given application and is not viewed to be the crux of the present invention. However, for completeness, both the shielded and the unshielded embodiments are set forth herein.

In a shielded embodiment, the core 45 is enclosed in a sheath system 50 (see FIG. 1*b*). The sheath system may include a core wrap 51 and an inner jacket 52 which comprises a material having a relatively low dielectric constant. In a preferred embodiment, the polyvinyl chloride (PVC) material.

In the shielded version, the inner jacket 52 is enclosed in a laminate 53 (see FIG. 1*b*) comprising a metallic shield 54 and a plastic film 55 and having a longitudinally extending overlapped seam 56. The laminate is arranged so that the plastic film faces outwardly. In a preferred embodiment, the thickness of the metallic shield 54, which typically is made of aluminum, is 0.001 inch whereas the thickness of the film is 0.002 inch. A drain wire 59, which may be a stranded or a solid wire, is disposed between the shield 54 and the inner jacket 52. The metallic shield 54 is enclosed in an outer jacket 58 which comprises a plastic material such as polyvinyl chloride, for example. In a preferred embodiment, the thickness of the outer jacket 58 is about 0.020 inch.

The absence of individual pair shielding overcomes another objection to prior art cables. The outer diameter of the insulation cover 46 about each metallic conductor is small enough so that the insulated conductor can be terminated with standard connector hardware.

The two embodiments described above, shielded and unshielded, are believed to be the most common form of cabling media to employ the present invention. However, other forms of communication transmission may be within the scope of the present invention. For example, the plurality of pairs may be disposed side by side in a wiring trough and not be enclosed in a plastic jacket or any other type of common sheath system as yet another embodiment of the present invention. While the particular embodiments shown herein are round in design, it is noted that the attributes of the present invention could also be realized by other cable design regardless of their shape.

In addition to the particular type of sheath system used in accordance with the novel insulated conductor aspects of the present invention, the materials for the conductor insulation and/or the jacket(s) may be such as to render the cable flame retardant and smoke suppressive. For example, those materials may be fluoropolymers. Underwriters Laboratories has implemented a testing standard for classifying communications cables based on their ability to withstand exposure to heat, such as from a building fire. Specifically, cables can be either riser or plenum rated. Currently, UL 910 Flame Test is the standard that cables are subjected to prior to receiving a plenum rating. It is intended that the preferred embodiment of the present invention use materials for the jacket and/or conductor insulations such that the cable qualifies for a plenum rating. To achieve such a plenum rating, any number of the known technologies may be incorporated into a cable exhibiting the other specific attributes touted and claimed herein. Even given the aforementioned preference, it should be understood that a cable made in accordance with the present invention does not require such attention to or benefits from the jacketing and insulation material selected. In fact, other particular testing standards may be applied and used to qualify cables incorporating the attributes of the present invention depending on the specific environment into which the cable is going to be placed.

The pairs of insulated conductors 42—42 are adjacent to one another in a cable or in a wiring trough, for example. Therein, the pairs are in close proximity to one another and protection against crosstalk must be provided.

The characterization of the twisting of the conductors of each pair is important for the cable of this invention to provide substantially error-free transmission at relatively high bit rates. However, the particulars of the various twist schemes used to date to enhance the performance of a LAN cable will not be specifically addressed herein. Instead, the reader's attention is directed to the prior art identified earlier, each of which is expressly incorporated by reference herein. Regardless of which, if any, aspects of these previously described twist schemes is employed, incorporation of the teachings of the present invention will significantly enhance the operational performance of the resulting cable.

In addition to the specific design factors discussed above, a number of other factors must also be considered to arrive at a cable design which is readily marketable for such uses. The jacket of the resulting cable should exhibit low friction to enhance the pulling of the cable into ducts or over supports. Also, the cable should be strong, flexible and crush-resistant, and it should be conveniently packaged and not unduly weighty. Because the cable may be used in occupied building spaces, flame retardance also is important.

The data transmission cable should be low in cost. It must be capable of being installed economically and be efficient in terms of space required. It is not uncommon for installation costs of cables in buildings, which are used for interconnection, to outweigh the cable material costs. Building cables should have a relatively small cross-section inasmuch as small cables not only enhance installation but are easier to conceal, require less space in ducts and troughs and wiring closets and reduce the size of associated connector hardware.

Cable connectorability is very important and is more readily accomplished with twisted insulated conductor pairs than with any other medium. A widely used connector for insulated conductors is one which is referred to as a split beam connector. Desirably, the outer diameter of insulated conductors of the sought-after cable is sufficiently small so that the conductors can be terminated with such existing connector systems.

Further, any arrangement proposed as a solution to the problem should be one which does not occupy an undue amount of space and one which facilitates a simplistic connection arrangement. There is a need to provide cables that can transmit data rates of up to gigabits per second, error-free, from stations to closets or between computer cabinets separated by comparable distances to main rooms, be readily installed, fit easily into building architectures, and be safe and durable.

It should be understood that the above-described arrangements are simply illustrative of the invention. Other arrangements may be devised by those skilled in the art which will embody the principles of the invention and fall within the scope and spirit thereof.

What is claimed is:

1. A cabling media, comprising:

at least one first conductor-pair having a pair of first metallic conductors, each of the first metallic conductors having a first amount of metal per a unit length, the first metallic conductors being surrounded by a first insulation material having a first thickness, the at least one first conductor-pair having a first twist length;

at least one second conductor-pair having a pair of second metallic conductors, each of the second metallic conductors having a second amount of metal per the unit length, the second metallic conductors being surrounded by a second insulation material having a second thickness, the at least one second conductor-pair having a second twist length; and wherein the first amount of the metal per the unit length is different than the second amount of metal per the unit length, the first thickness is different than the second thickness, the first twist length is different than the second twist length, and the first insulation material is the same as the second insulation material.

2. The cabling media of claim 1, wherein the at least one first conductor-pair has a first insertion loss and the at least one second conductor-pair has a second insertion loss, the first and second insertion losses being substantially equal.

3. The cabling media of claim 1, wherein the at least one first conductor-pair has a first characteristic impedance and the at least one second conductor-pair has a second characteristic impedance, the first characteristic impedance and the second characteristic impedance being substantially equal.

4. The cabling media of claim 1, wherein the first and second insulation materials further comprises a flame retardant material.

5. The cabling media of claim 1, wherein there are two first conductor-pairs and two second conductor-pairs, the two first conductor-pairs being positioned diagonal relative to each other and the two second conductor-pairs being positioned diagonal relative to each other.

6. The cabling media of claim 1, further comprising a jacket surrounding the at least one first conductor-pair and the at least one second conductor-pair, the jacket being comprised of a flame retardant material.

7. The cabling media of claim 1, wherein a wire size of at least one of the first and second metallic conductors is selected from a group consisting of 22 AWG, 23 AWG, 24 AWG, 25 AWG, or 26 AWG, where AWG refers to the American Wire Gauge standard.

8. A local area network, comprising:

at least two data communications devices, the data communication devices being in electrical communication with each other via a cabling media;

wherein the cabling media comprises:

at least one first conductor-pair having a pair of first metallic conductors, each of the first metallic conductors having a first amount of metal per a unit length, the first metallic conductors being surrounded by a first insulation material having a first thickness, the at least one first conductor-pair having a first twist length;

at least one second conductor-pair having a pair of second metallic conductors, each of the second metallic conductors having a second amount of metal per the unit length, the second metallic conductors being surrounded by a second insulation material having a second thickness, the at least one second conductor-pair having a second twist length; and wherein the first amount of the metal per the unit length is different than the second amount of metal per the unit length, the first thickness is different than the second thickness, the first twist length is different than the second twist length, and the first insulation material is the same as the second insulation material.

9. The cabling media of claim 8, wherein the at least one first conductor-pair has a first insertion loss and the at least one second conductor-pair has a second insertion loss, the first and second insertion losses being substantially equal.

10. The cabling media of claim 8, wherein the at least one first conductor-pair has a first characteristic impedance and the at least one second conductor-pair has a second characteristic impedance, the first characteristic impedance and the second characteristic impedance being substantially equal.

11. The cabling media of claim 8, wherein the first and second insulation materials further comprises a flame retardant material.

12. The cabling media of claim 8, wherein there are two first conductor-pairs and two second conductor-pairs, the two first conductor-pairs being positioned diagonal relative to each other and the two second conductor-pairs being positioned diagonal relative to each other.

13. The cabling media of claim 8, further comprising a jacket surrounding the at least one first conductor-pair and the at least one second conductor-pair, the jacket being comprised of a flame retardant material.

14. The cabling media of claim 8, wherein a wire size of at least one of the first and second metallic conductors is selected from a group consisting of 22 AWG, 23 AWG, 24 AWG, 25 AWG, or 26 AWG, where AWG refers to the American Wire Gauge standard.

* * * * *